US009187220B2

(12) United States Patent
Biesecker et al.

(10) Patent No.: US 9,187,220 B2
(45) **Date of Patent: *Nov. 17, 2015**

(54) CHILD-RESISTANT CAP AND CONTAINER ASSEMBLY

(71) Applicant: Drug Plastics & Glass Company, Inc., Boyertown, PA (US)

(72) Inventors: Frederick Biesecker, Boyertown, PA (US); Gregory Sprishen, Newtown Square, PA (US); William Gordon Knestrick, III, Macungie, PA (US)

(73) Assignee: Drug Plastics & Glass Company, Inc., Boyertown, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/324,565

(22) Filed: Jul. 7, 2014

(65) Prior Publication Data

US 2015/0014270 A1 Jan. 15, 2015

Related U.S. Application Data

(63) Continuation of application No. 13/528,991, filed on Jun. 21, 2012, now Pat. No. 8,777,032.

(60) Provisional application No. 61/499,402, filed on Jun. 21, 2011.

(51) Int. Cl.

| | |
|---|---|
| ***B65D 39/16*** | (2006.01) |
| ***B65D 50/04*** | (2006.01) |
| ***B65D 43/02*** | (2006.01) |
| ***B65D 51/18*** | (2006.01) |

(52) U.S. Cl.

CPC ..... *B65D 50/046* (2013.01); *B65D 43/0212* (2013.01); *B65D 50/045* (2013.01); *B65D 51/18* (2013.01); *B65D 2251/0015* (2013.01); *B65D 2251/0075* (2013.01)

(58) Field of Classification Search

CPC ..... B65D 50/04; B65D 50/02; B65D 2251/0075; B65D 43/0212; B65D 50/046; B65D 50/045

USPC ..... 220/780, 794, 784, 281; 215/352, 347, 215/305, 224, 301, 317, 321

See application file for complete search history.

(56) References Cited

U.S. PATENT DOCUMENTS

| | | | | |
|---|---|---|---|---|
| 1,426,209 | A | 8/1922 | Newland | |
| 1,580,544 | A | 4/1926 | Spengler | |
| 2,218,308 | A | 10/1940 | Comer | |
| 3,170,588 | A | 2/1965 | Lyon, Sr. | |
| 3,330,720 | A * | 7/1967 | Stevens et al. | 428/321.5 |

(Continued)

*Primary Examiner* — Jeffrey Allen

(74) *Attorney, Agent, or Firm* — Panitch Schwarze Belisario & Nadel LLP

(57) ABSTRACT

A cap includes a top wall, an outer peripheral edge, a first section, and a second section. A skirt depends from the outer peripheral edge. The skirt includes an attached end, a free end, a plurality of slots, and a plurality of apertures. Each aperture is spaced-apart from the free end of the skirt. The top wall has a first configuration and a second configuration. When the top wall is in the first configuration, the first section is generally planer and the second section is generally arcuate. When the top wall is in the first configuration, the skirt extends generally perpendicularly to the first section to generally engage at least a portion of a container. When the top wall is in the second configuration, the free end of the skirt extends radially outwardly from the attached end thereof to allow the cap to be removed from the container.

19 Claims, 7 Drawing Sheets

(56) References Cited

U.S. PATENT DOCUMENTS

| | | | | |
|---|---|---|---|---|
| 3,782,575 | A | 1/1974 | Braun | |
| 3,825,143 | A | 7/1974 | Julian | |
| 3,853,237 | A | 12/1974 | Marchant | |
| 3,934,745 | A | 1/1976 | Lovell | |
| 4,180,178 | A | 12/1979 | Turner | |
| 4,500,006 | A | 2/1985 | Lafortune et al. | |
| D298,608 | S | 11/1988 | Dewing | |
| D311,868 | S | 11/1990 | Armstrong | |
| D327,849 | S | 7/1992 | Armstrong | |
| D361,265 | S | 8/1995 | Doxey | |
| 5,597,096 | A | 1/1997 | Jeppesen et al. | |
| D409,490 | S | 5/1999 | Page | |
| 6,024,246 | A | 2/2000 | Huang | |
| D448,669 | S | 10/2001 | Carducci et al. | |
| D457,433 | S | 5/2002 | Costanzo et al. | |
| D481,946 | S | 11/2003 | Nicholson et al. | |
| D544,348 | S | 6/2007 | Szczesniak | |
| D563,785 | S | 3/2008 | Maki et al. | |
| D565,027 | S | 3/2008 | Fosbrink | |
| D605,038 | S | 12/2009 | Olive-Bartres et al. | |
| D618,099 | S | 6/2010 | Biesecker et al. | |
| 2004/0195241 | A1* | 10/2004 | Stull et al. | 220/326 |
| 2009/0223967 | A1* | 9/2009 | Mengeu et al. | 220/326 |

* cited by examiner

CHILD-RESISTANT CAP AND CONTAINER ASSEMBLY

CROSS-REFERENCE TO RELATED APPLICATIONS

The present application is a continuation of U.S patent application Ser. No. 13/528,991, filed Jun. 21,2012 and claims the benefit of U.S. Provisional Patent Application No. 61/499,402, filed Jun. 21, 2011, entitled "Container and Cap Assembly," the subject matters of which are hereby incorporated by reference.

BACKGROUND OF THE INVENTION

The present invention relates generally to container assemblies and, more specifically, to a combination container and a removable cap.

Container assemblies for pharmaceutical or nutritional products as well as other components are well known. Container assemblies typically include a cap for containing a pharmaceutical or nutritional product within a bottle or other container. The cap may be "child-resistant," which can mean that the cap may be difficult to remove from the container and/or the cap has passed performance tests with respect to a degree or level of difficulty in removing the cap from the container.

Conventional child-resistant caps often require fulcrum points or fulcrum elements to remove the cap from the container. Fulcrum elements may impinge against and damage seals and/or liners used between the cap and the container to maintain the pharmaceutical or nutritional product in a desired state. Fulcrum elements occupy or require a certain amount of space, which can undesirably limit the size of the seals and/or the liners. Moreover, fulcrum elements can add an extra design variable that can limit or undesirably dictate how other features of the cap and container are designed.

It is heretofore not been discovered how to make a container assembly for pharmaceutical or nutritional products that includes a child-resistant cap that requires no fulcrum element to assist in removing the cap from the container. The device in the present invention overcomes and/or eliminates at least one of the above or other shortcomings of the conventional devices.

BRIEF SUMMARY OF THE INVENTION

Briefly stated, a preferred embodiment of the present invention is directed to a child-resistant cap including a top wall having an exterior surface, an opposing interior surface, a generally circular outer peripheral edge, a first section spaced inwardly from the outer peripheral edge, and a second section spaced inwardly from the first section. The first section generally surrounds the second section. A skirt depends downwardly from the outer peripheral edge of the top wall. The skirt includes an attached end integrally formed with at least a portion of the outer peripheral edge of the top wall, an opposing free end, a plurality of spaced-apart slots extending through the skirt, and a plurality of spaced-apart apertures extending through the skirt. Each slot extends from the free end of the skirt and toward the outer peripheral edge of the top wall. Each aperture is spaced-apart from the free end of the skirt. A first liner has a top surface, an opposing bottom surface, and an outer peripheral edge. At least a portion of the top surface of the first liner is attached to at least a portion of the interior surface of the top wall. The top wall has a first configuration in which the geometric center of the top wall extends beyond a plane defined by the outer peripheral edge thereof and the attached edge of the skirt. The top wall also has a second configuration in which the geometric center of the top wall does not extend beyond the plane defined by the outer peripheral edge thereof and the attached edge of the skirt. When the top wall is in the first configuration, the first section of the top wall is generally planer and the second section of the top wall is generally arcuate. When the top wall is in the first configuration, the skirt extends generally perpendicularly to the first section of the top wall to generally engage at least a portion of a container. When the top wall is in the second configuration, the free end of the skirt extends radially outwardly from the attached end thereof to allow the cap to be removed from the container.

In another aspect, the present invention is directed to a container including a container having a bottom with an outer periphery, a neck defining an opening at a top portion thereof for receiving a pharmaceutical or nutritional product and a shoulder proximate a bottom portion thereof, and a side wall extending generally upwardly from the periphery of the bottom to the shoulder of the neck. A child-resistant cap for engaging at least a portion of the neck includes a top wall having an exterior surface, an opposing interior surface, a generally circular outer peripheral edge, a first section spaced inwardly from the outer peripheral edge, and a second section spaced inwardly from the first section. The first section generally surrounds the second section. A skirt depends downwardly from the outer peripheral edge of the top wall. The skirt includes an attached end integrally formed with at least a portion of the outer peripheral edge of the top wall, an opposing free end, a plurality of spaced-apart slots extending through the skirt, and a plurality of spaced-apart apertures extending through the skirt. Each slot extends from the free end of the skirt and toward the outer peripheral edge of the top wall. Each aperture is spaced-apart from the free end of the skirt. A first liner has a top surface, an opposing bottom surface, an outer peripheral edge, and an opposing inner edge defining a central opening. At least a portion of the top surface of the first liner is attached to at least a portion of the interior surface of the top wall. The top wall has a first configuration in which the geometric center of the top wall extends beyond a plane defined by the outer peripheral edge thereof and the attached edge of the skirt. The top wall also has a second configuration in which the geometric center of the top wall does not extend beyond the plane defined by the outer peripheral edge thereof and the attached edge of the skirt. When the top wall is in the first configuration, the first section of the top wall is generally planer and the second section of the top wall is generally arcuate. When the top wall is in the first configuration, the skirt extends generally perpendicularly to the first section of the top wall to generally engage at least a portion of the neck of the container. When the top wall is in the second configuration, the free end of the skirt extends radially outwardly from the attached end thereof to allow the cap to be removed from the neck of the container.

In yet another aspect, a preferred embodiment of the present invention is directed to a cap including a top wall having an exterior surface, an opposing interior surface, an outer peripheral edge, a first section spaced inwardly from the outer peripheral edge, and a second section spaced inwardly from the first section. A skirt depends downwardly from the outer peripheral edge of the top wall. The skirt includes an attached end integrally formed with at least a portion of the outer peripheral edge of the top wall, an opposing free end, a plurality of spaced-apart slots extending through the skirt, and a plurality of spaced-apart apertures extending through the skirt. Each aperture is spaced-apart from the free end of the skirt. The top wall has a first configuration in which the geometric center of the top wall extends beyond a plane defined by the outer peripheral edge thereof and the attached edge of the skirt. The top wall also has a second configuration in which the geometric center of the top wall does not extend beyond the plane defined by the outer peripheral edge thereof and the attached edge of the skirt. When the top wall is in the first configuration, the first section of the top wall is generally planer and the second section of the top wall is generally arcuate. When the top wall is in the first configuration, the skirt extends generally perpendicularly to the first section of the top wall to generally engage at least a portion of a container. When the top wall is in the second configuration, the free end of the skirt extends radially outwardly from the attached end thereof to allow the cap to be removed from the container.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. In the drawings.

DETAILED DESCRIPTION OF THE INVENTION

Figure 1:
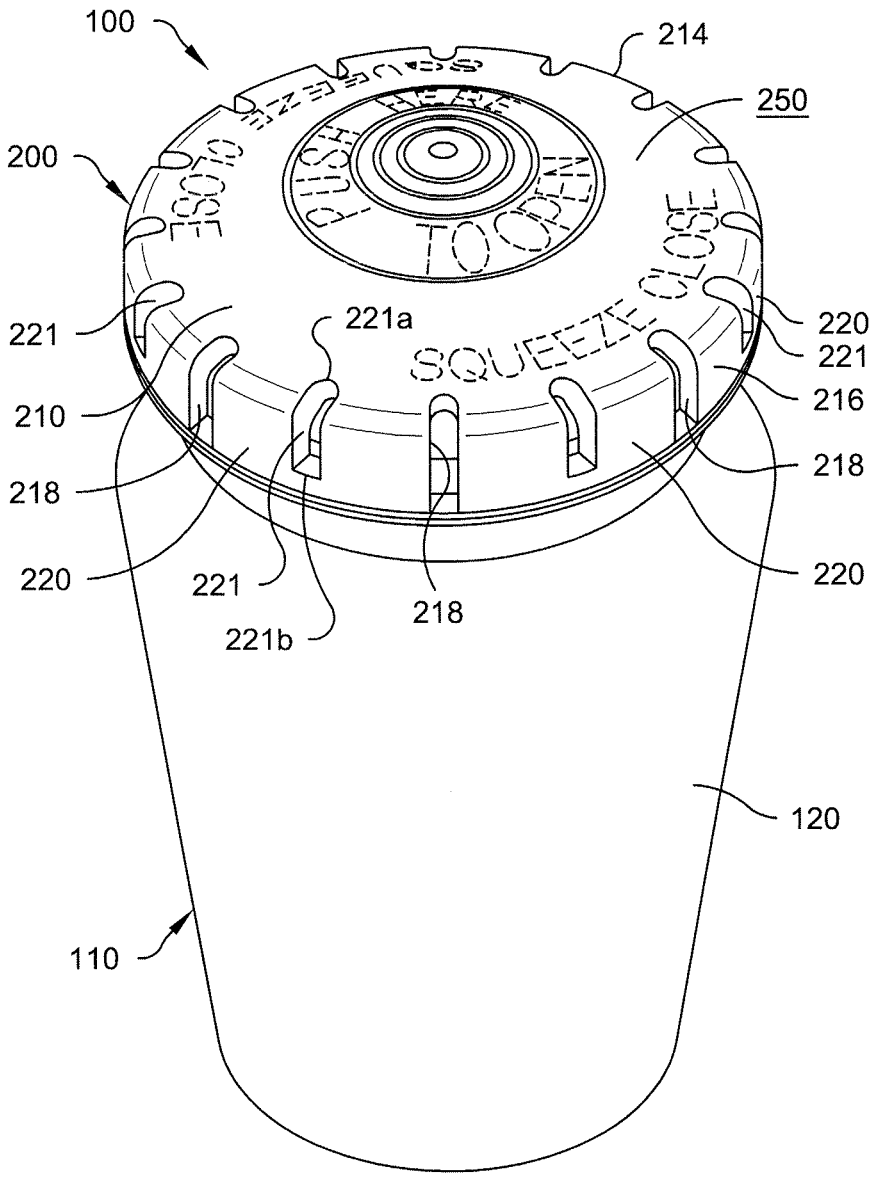
FIG. 1 is an enlarged top perspective view of a container assembly in accordance with a preferred embodiment of the present invention.

Certain terminology is used in the following description for convenience only and is not limiting. The words "lower," "bottom," "upper" and "top" designate directions in the drawings to which reference is made. The words "inwardly" and "outwardly" refer to a direction toward and away from, respectively, the geometric center of the device, and designated parts thereof, in accordance with the present invention. Unless specifically set forth herein, the terms "a," "an" and "the" are not limited to one element, but instead should be read as meaning "at least one." The terminology includes the words noted above, derivatives thereof and words of similar import.

Referring to the drawings in detail, wherein like numerals indicate like elements throughout, FIGS. 1-10 show a container assembly, generally designated 100, in accordance a preferred embodiment of the present invention. The container assembly 100 may be used for storing and/or dispensing pharmaceutical or nutritional products, such as tablets, caplets or other forms of medication. However, the container assembly 100 can be used for storing various types of material other than medication, such as a powder for drug reconstitution. The container assembly 100 preferably includes a container 110 and a cap 200 that cooperates with and/or is selectively attachable to the container 110. The container 110 is preferably formed of high density polyethylene (HDPE) or any material that is appropriate for the contents to be stored in the container 110. The cap 200 is preferably formed of material exhibiting elastic and shape memory characteristics, such as a polymeric material, for example, polypropylene.

As used herein, the term "container" refers to any type of storage receptacle for holding solid, liquid or gaseous material, including but not limited to bottles, vials, tubes, vessels, or other receptacles, having at least one opening for depositing or dispensing contents therefrom. The term "cap" refers to any type of closure for closing the opening of a container, including but not limited to lids, covers and seals. The term "child-resistant" as used herein means that the cap may be difficult for a child to remove from the container.

Figure 2:
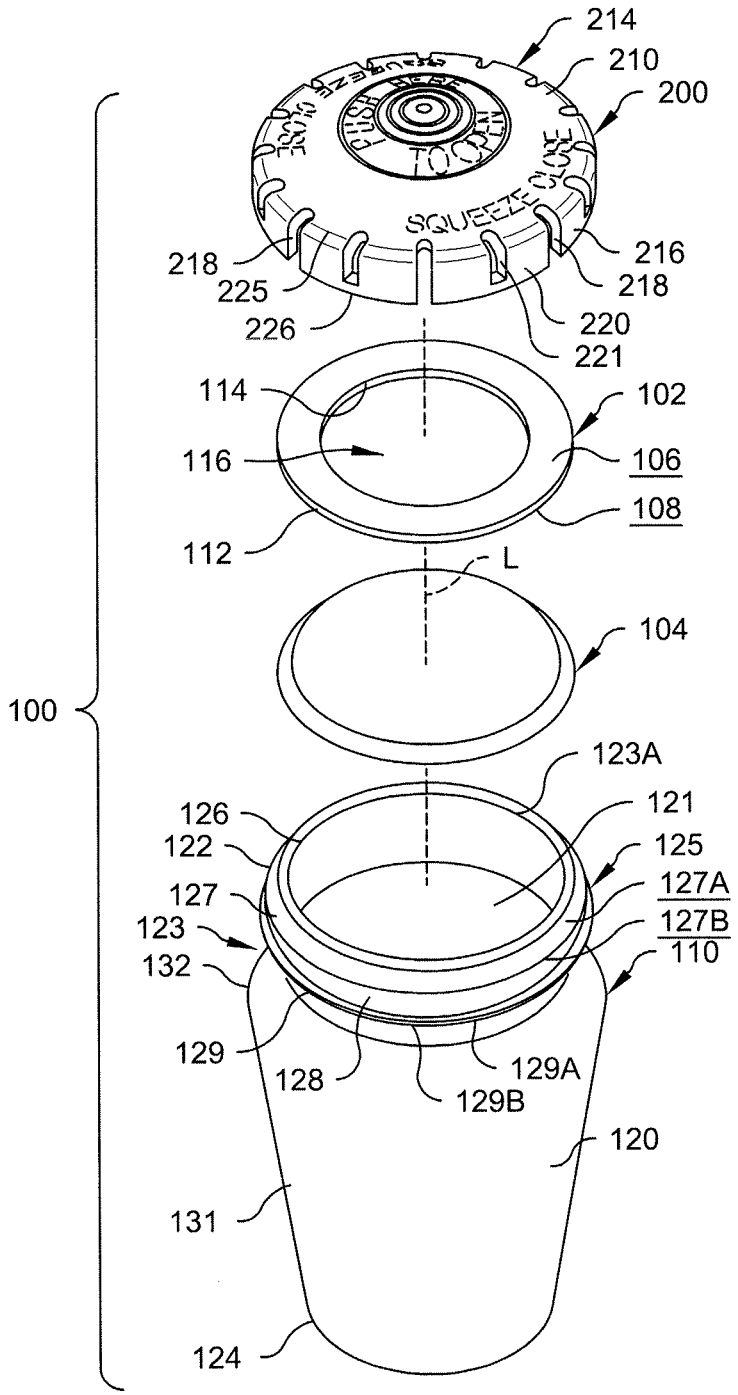
FIG. 2 is an exploded top perspective view of the container assembly of FIG. 1.

Referring to FIGS. 1-3, 9 and 10, the container 110 preferably has a generally cylindrical body 120 defining a cavity or containment area 121 (see FIG. 2) therein. However, the container 110 may have one of any of a number of cross-sectional configurations, including cylindrical, oblong or polygonal. As shown in FIG. 2, the body 120 preferably has a first or upper end 122, an opposing second or lower end 124, and a sidewall 131 that extends therebetween. The first end 122 preferably includes a neck 123 that forms a lip 123A that surrounds an opening 126. A shoulder 132 is preferably formed below the opening 126 proximate to a bottom portion of the neck 123. The opening 126 preferably provides access into the containment area 121, so that medication, nutritional products or other components can be deposited into the container 110 and dispensed from the container 110. The sidewall 131 preferably extends generally upwardly from an outer periphery of the lower end 124 to the shoulder 132 of the neck 123.

Figure 5:
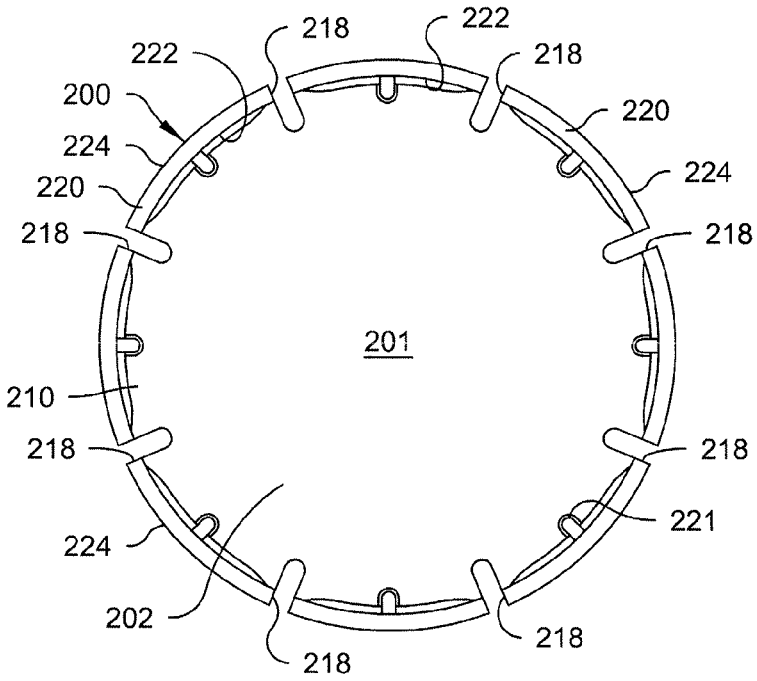
FIG. 5 is a bottom plan view of the cap of FIG. 4.
Figure 6:
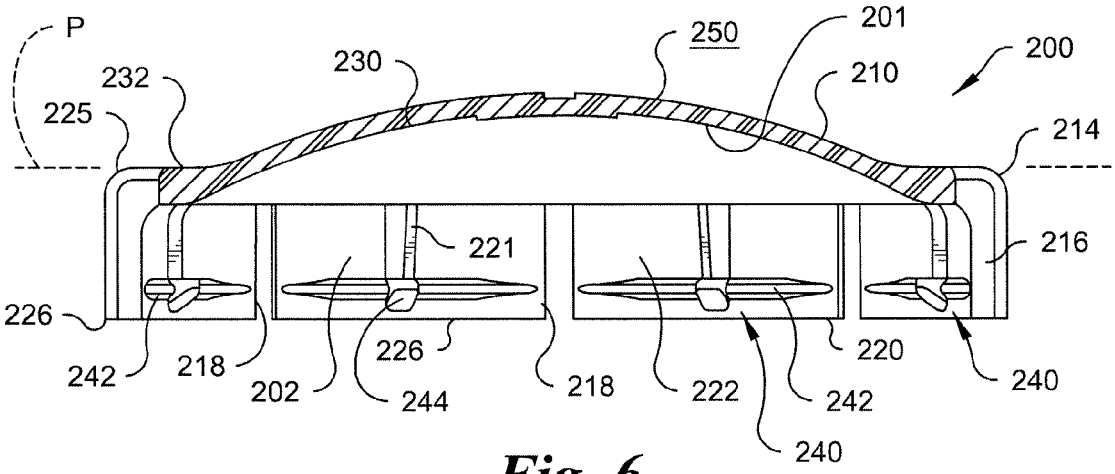
FIG. 6 is an enlarged cross-sectional elevational view of the cap of FIG. 4 in a non-inverted state, taken through line 6-6 shown in FIG. 4.

The cap 200 preferably includes a body portion or top wall 210 having a first or exterior surface 250, an opposing interior or underside surface 201, and a generally circular outer peripheral or perimeter edge 214. A skirt 216 preferably extends downwardly and/or generally perpendicular from the perimeter edge 214. As shown in FIGS. 5 and 6, the body portion 210 and the skirt 216 preferably define a cap space or volume 202 adapted to receive at least a portion of the first or upper end 122 of the container 110. The cap 200 may or may not be child-resistant. The cap 200 requires no fulcrum element to assist in removing the cap 200 from the container 110. This is advantageous because fulcrum elements can impinge against and damage seals and liners used between the cap 200 and the container 110. Fulcrum elements also occupy space, which can limit the size of seals and liners. Moreover, fulcrum elements add an extra design variable that can limit how other features of the cap 200 and the container 110 can be designed.

The container 110 preferably includes a number of features facing different orientations. For purposes of this description, the orientation of features will be described relative to a longitudinal axis of the container assembly 100. The term "longitudinal axis," as used herein, is defined as an axis passing through the center of the cap 200 and center of the container 110 when the cap 200 and the container 110 are assembled or aligned for assembly with one another. The longitudinal axis of the container assembly 100 is shown by the axis line "L" in FIG. 2.

Figure 3:
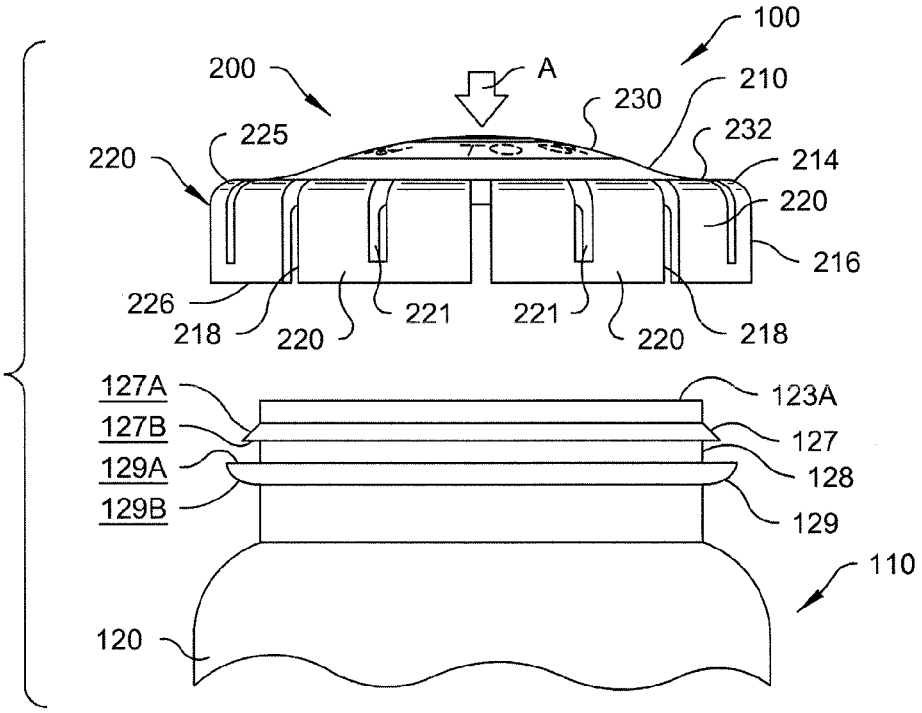
FIG. 3 is an enlarged exploded partial side elevation view of a portion of the container assembly of FIG. 1.
Figure 4:
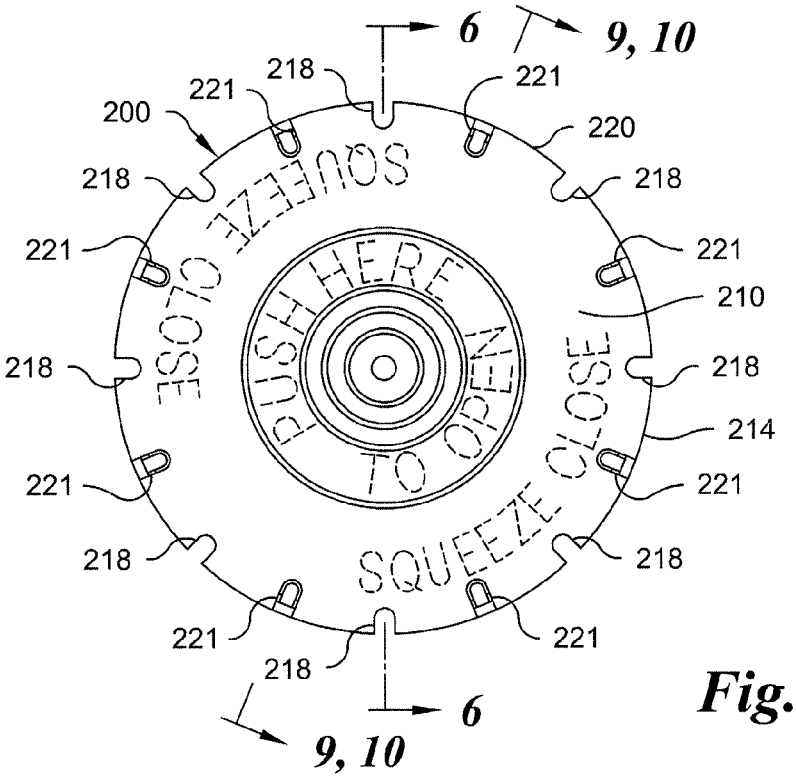
FIG. 4 is an enlarged top plan view of the a cap of the container assembly of FIG. 1.

The container 110 preferably includes one or more securing elements for engagement with the cap 200. The securing element(s) is/are preferably located adjacent to at least a portion of the opening 126. For example, as shown in FIGS. 2 and 3, the container 110 may include a securing element 125 that completely surrounds the neck 123 adjacent to opening 126. The securing element 125 preferably includes a first annular rim 127 and a second annular rim 129 axially spaced-apart therefrom. Each of the first and second rims 127, 129 preferably extend laterally outwardly from the neck 123 and preferably extend around the entire periphery of an exterior of the neck 123 of the container 110. The first rim 127 and the second rim 129 are preferably separated or axially spaced-apart from one another by an annular groove 128 that also extends around the periphery of the neck 123.

As shown in FIGS. 2, 3, 9 and 10, the first rim 127 preferably includes a first edge or surface 127A and a second edge or surface 127B. The first edge 127A is preferably a tapered or sloped edge oriented at an acute angle, such as approximately forty five degrees, relative to the longitudinal axis L. The second edge 127B is preferably oriented at an angle of about ninety degrees relative to longitudinal axis L. As explained in detail below, the tapered first edge 127A preferably assists with placing the cap 200 on the container 110, and the second edge 127B assists with securing and releasably locking the cap 200 on the container 110 after the cap 200 is placed on the container 110. The second rim 129 preferably includes a first edge or surface 129A and second edge or surface 129B. The first and second edges 129A, 129B of the second rim 129 may extend generally parallel to one another, and extend generally perpendicularly to the longitudinal axis L. Alternatively, as shown in FIG. 3, the second edge 129B of the second rim 129 may be at least partially arcuate in shape, while the first edge 129A of the second rim 129 may be generally flat or planar in shape. The diameter of the second rim 129 is preferably greater than the diameter of the first rim 127, such that the second rim 129 projects radially outwardly at least slightly further from longitudinal axis L than the first rim 127. The second rim 129 may function as a "stop" to properly position the cap 200 for engagement with the container 110.

Referring to FIGS. 1-3, 6, 7, 9 and 10, the skirt 216 preferably has a fixed end 225 and an opposing free end 226. The fixed end 225 of the skirt 216 preferably connects and/or is integrally formed with the body portion 210 at the outer peripheral edge 214 of the cap 200. The fixed end 225 of the skirt 216 may be positioned at or proximate the outer peripheral edge 214 of the top wall of the cap 200. In other words, the fixed end 225 may be integral with or the same structure as the outer peripheral edge 214 of the top wall of the cap 200.

Referring to FIGS. 1-8, the skirt 216 of the cap 200 preferably has a plurality of slots 218 circumferentially spaced-apart around a perimeter thereof. The slots 218 are preferably generally identical in shape and dimension. Eight equidistantly spaced-apart slots 218 are shown in the figures, but the present invention is not limited to such a number and configuration of the slots 218. With this slot arrangement, the skirt 216 is preferably divided into eight flanges 220 of generally equal size, shape and/or configuration. Each slot 218 preferably extends completely through at least a portion of the skirt 216. Each slot 218 preferably extends from the free end 226 of the skirt 216 and toward the outer peripheral edge 214 of the body portion 210 to define the flanges 220. More specifically, each slot 218 preferably extends from the free end 226 of the skirt 216, through the outer peripheral edge 214 and into at least a portion of the first section 232 of the base portion 210

Figure 8:
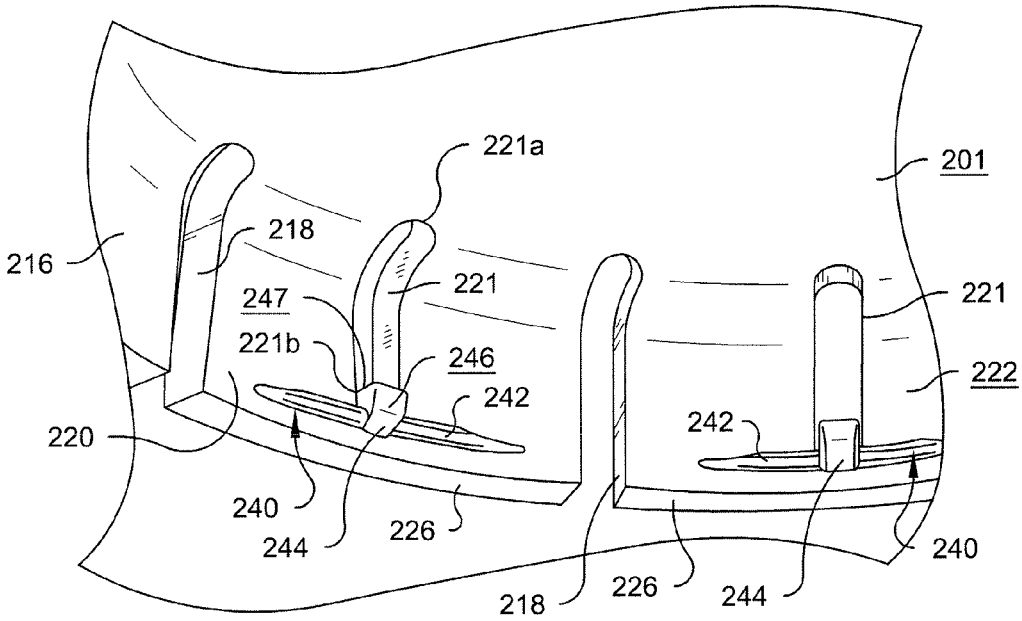
FIG. 8 is a greatly enlarged partial bottom perspective view of a portion of the cap of FIG. 4.
Figure 9:
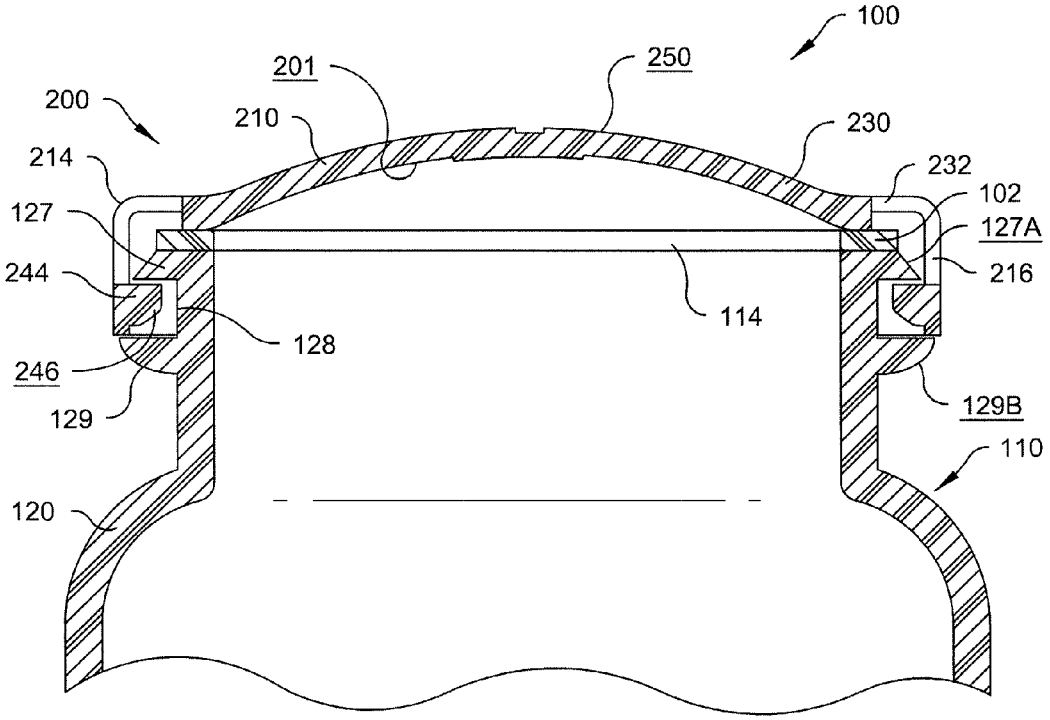
FIG. 9 is an enlarged partial cross-sectional elevational view of the cap taken through line 9-9 shown in FIG. 4 in the non-inverted state attached to a container of the container assembly.

Each flange 220 preferably includes at least one and preferably a plurality of circumferentially spaced-apart apertures or windows 221. The windows 221 may be equidistantly spaced-apart around the circumference of the cap 200, but such a configuration or arrangement is not required. One of the windows 221 is preferably circumferentially positioned between each adjacent pair of the slots 218. The windows 221 are preferably smaller in size than the slots 218. As shown in FIGS. 1 and 8, each window 221 preferably extends from a first or top end 221*a* to a second or lower end 221*b*. The top end 221*a* of each window 221 is preferably positioned in the first section 232 of the body portion 210. The lower end 221*b* of each window 221 is preferably positioned or spaced a predetermined axial distance apart from the free end 226 of the skirt 216. As such, each window 221 preferably extends through the skirt and through at least a portion of the first section 232 of the base portion 210. The cap 200 preferably has sixteen axes of symmetry as a result of the combination of the slots 218 and the windows 221. However, the cap 200 is not limited to inclusion of one or more windows 221.

The cap 200 preferably includes securing elements that are preferably uniformly and symmetrically arranged around the perimeter of the cap volume 202. The symmetry allows the cap 200 to be compatible with a variety of bottle configurations, as will be discussed in more detail below. As shown in FIG. 5, each flange 220 preferably includes an inner face or surface 222 that is oriented beneath the body portion 210 toward the cap volume 202, and an outer face or surface 224 opposite the inner face 222. The inner face 222 of each flange 220 preferably includes a securing element for securing the cap 200 onto the container 110. The securing elements may include various types of projections, including but not limited to hooks, tangs, tabs, bosses, ribs, beads or any combination thereof.

Figure 7:
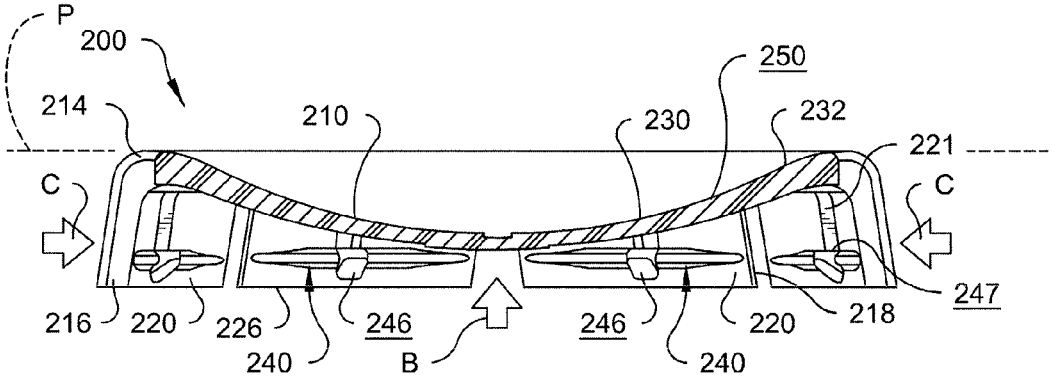
FIG. 7 is an enlarged cross-sectional elevational view of the cap of FIG. 4 in an inverted state.

In particular, referring to FIGS. 5-8, each flange 220 preferably includes a securing element 240 that features an elongated rib 242 extending generally parallel to the free end 226 thereof. The cap 200 preferably includes a plurality of spaced-apart hooks 244, and each hook 244 preferably projects radially inwardly from the center of each rib 242. Each hook 244 is preferably axially or vertically aligned with one of the windows 221, such that one hook 244 is positioned proximate the second end 221*b* of the respective window 221. The plurality of hooks 244 may be equidistantly spaced-apart around a periphery of the interior of the skirt 216, but the present invention is not limited to such a configuration. As shown in FIGS. 7 and 8, each hook 244 preferably has a tapered or sloped inward surface 246 and a flat surface 247, which is preferably aligned with the second end 221*b* of each respective window 221. As described in detail below, each hook 244 is preferably sized and shaped to engaged at least a portion of the first rim 127 when the base portion 210 of the cap 200 is secured to the container 110.

Referring to FIGS. 2, 6, 7, 9 and 10, the body portion 210 of the cap 200 preferably includes a first section 232 and a second section 230. The first section 232 is preferably a generally flat annular portion and the second section 230 is preferably at least slightly arcuate, concave or convex. The first section 232 is preferably spaced radially inwardly from the outer peripheral edge 214 of the body portion 210 of the cap 200. The second section 230 is preferably spaced radially inwardly from the first section 232, such that the first section 232 generally surrounds the second section 230 and separates the second section 230 from the outer peripheral edge 214. The second section 230 preferably forms a dome shaped protuberance that extends from the first section 232 in a direction axially away from and out of the plane of (i.e., upwardly or downwardly) the first section 232 and the flanges 220.

Figure 10:
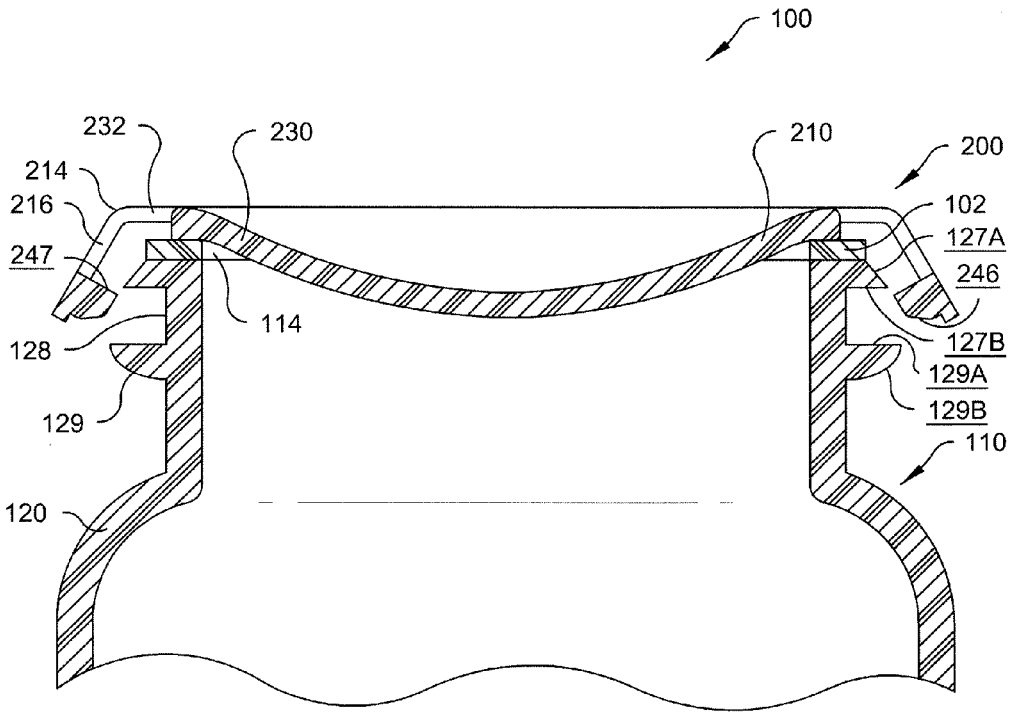
FIG. 10 is an enlarged partial cross-sectional elevational view of the cap taken through line 9-9 shown in FIG. 4 in the inverted state engaging the container of the container assembly.

The second section 230 and the first section 232 are preferably movable or deflectable between a first configuration (see FIGS. 1-3, 6 and 9) and a second configuration (see FIGS. 7 and 10). In the first configuration, a geometric center of the base portion 210 preferably extends upwardly beyond a plane P (see FIG. 6) defined by the outer peripheral edge 214 and the attached edge 225 of the skirt 216. In the first configuration at least the base portion 210 is in a "non-inverted" position. In the non-inverted position, the flanges 220 preferably extend generally parallel to the longitudinal axis L, and the body portion 210 is preferably bowed with the second section 230 deflected upwardly away from the free ends 226 of the flanges 220. As a result, the skirt 216 extends generally perpendicularly to the first section 232 to allow at least a portion of the skirt 216 of the cap 200 to engage at least a portion of the container 110. In the first configuration, the first section 232 of the base portion 210 is preferably generally flat or planar and the second section 230 of the base portion 210 is preferably at least generally arcuate or non-planar.

In the second configuration, the geometric center of the base portion 210 preferably does not extend beyond the plane P (see FIG. 7) defined by the outer peripheral edge 214 and the attached edge 225 of the skirt 216. In other words, in the second configuration the geometric center of the base portion 210 extends downwardly below the plane P. In the second configuration at least the base portion 210 is in an inverted position. In the inverted position, each flange 220 is preferably in an at least slightly splayed condition, with the free end 226 thereof displaced radially outwardly relative to the body portion 210. As a result, the free end 226 of the skirt 216 extends radially outwardly from the attached end 225 thereof to allow the cap 200 to be removed from the container 110. The body portion 210 is preferably bowed with the second section 230 deflected downwardly toward the free ends 226 of the flanges 220.

The cap 200 is preferably deflectable between the inverted condition and the non-inverted condition by applying force to the body portion 210, or to the skirt 216, or both the body portion 210 and the skirt 216. In particular, deflection of the cap 200 from the non-inverted condition to the inverted condition can be accomplished by applying a downward force preferably to an exterior surface of the second section 230 of the base section 210 proximate a geometric center thereof, in the direction of arrow "A" shown in FIG. 3. The second section 230 and the first section 232 are preferably configured to deflect to the inverted condition in response to a downward force. After a certain amount of deflection, an internal spring bias (caused by the material from which the cap 200 is formed or the geometric/size/shape of the cap 220, for example) moves the second section 230 and the first section 232 toward the inverted condition. As the second section 230 and the first section 232 move to the inverted condition, at least the second section 230 preferably assumes a generally concave or bowl shape. The deflection of the second section 230 pulls the fixed ends 225 of the flanges 220 radially inwardly, which, in turn, forces the free ends 226 of the flanges 220 radially outwardly, as shown in FIGS. 7 and 10. The second section 230 and the first section 232 thus act as a built-in lever that lifts the fixed ends 225 and spreads apart the free ends 226 of flanges 220. In other words, at least a portion of the cap 200, such as the second section 230, acts as a living hinge that is movable between the engaged first configuration and the disengaged second configuration. The cap 200 is preferably reconfigurable from the inverted condition to the non-inverted condition by applying a radially inward force to opposing portions of the skirt 216.

Referring to FIG. 2, the container assembly 100 may be used with one or more liners or seals for protecting and preserving contents stored in the container 110. A first liner 102 is preferably attachable to the underside 201 of the cap 200. The attachment is preferably permanent, such that the first liner 102 is not removable from the cap 200 without at least partially rupturing or destroying the first liner 102. The attachment may be created by a thin layer of adhesive. Alternatively, the attachment may be created by molecularly bonding at least a portion of the first liner 102 to at least a portion of the underside surface 201 of the cap 200, such that under increased temperature and/or pressure at least a portion of the first liner 102 adheres to at least a portion of the underside 201 of the cap 200. The first liner 102 preferably remains attached to the underside surface 201 of the cap 200 to engage the lip 123A of the container 110 and reseal the cap 200 each time the cap 200 is placed onto the container 110. The first liner 102 is preferably formed of a resiliently deformable material so as to form a seal when the cap 200 is attached to the container 110. The first liner 102 may have at least a degree of structural memory, such that the first liner 102 returns to its original shape after being temporarily deformed. The first liner 102 may be formed of any of a variety of materials, including but not limited to foam, pulp, thermoplastic material or rubber. Alternatively, the first liner 102 may be formed by a hot liquid polymer that is compression molded into or onto the cap 200, which may eliminate the need for another liner and adhesive in order to keep the first liner 102 in place when the base portion 210 of the cap 200 flexes.

The first liner 102 preferably has an annular or ring-shaped geometry that conforms with the shape of the annular portion 232 on the underside 201 of the cap 200. More specifically, as shown in FIG. 2, the first liner 102 preferably includes a first or top surface 106, an opposing second or bottom surface 108, an outer peripheral edge 112, and an opposing inner edge 114. The inner edge 114 preferably defines a central opening 116 of the first liner 102. A circumference of the inner edge 114 of the first liner 102 is preferably generally equal to an outer circumference of the second section 230 of the base portion 210 of the cap 200. The above-described geometry of the first liner 102 preferably allows at least a portion of the top surface 106 of the first liner 102 to be attached to at least a portion of the underside 201 of the cap 200 along the annular portion 232 in a permanent manner, as described in detail above. The first liner 102 preferably does not overlap the center of the cap 200, which undergoes a larger amount of deflection (i.e., is displaced through a greater distance) than the annular portion 232 when the cap 200 is inverted. As a result, when the cap 200 is inverted, the first liner 102 preferably undergoes only a relatively small amount of deflection, if any, minimizing the potential for detachment of the first liner 102 from the cap 200. The first liner 102 remains on the underside of the cap 200 to reseal the container 110 each time the cap 200 is placed back on the container 110, and can function as a permanent seal that withstands repeated deflection of the cap 200 between the inverted and non-inverted conditions.

A second liner 104 is preferably directly attachable to the lip 123A of the container 110 with induction sealing, adhesive or other techniques, and is configured to be peeled off of the container 110 after the container 110 is first opened. In place of or in addition to one or both of the first and second liners 102, 104, the cap 200 may include a valve seal on the interior thereof, as disclosed in U.S. Application Publication No. 2005/0194343, which is herein incorporated by reference in its entirety. With the inclusion of the valve seal, the closure assembly 100 is be capable of storing and preserving liquid pharmaceutical, nutritional or other liquid products.

In operation, at least a portion of each of the securing elements 240 on the cap 200 are preferably configured to engage a securing element 125 on the container 110 to secure the cap 200 onto the container 110 in a releasable snap-fit connection. In particular, the ribs 242 and the hooks 244 are configured to snap into the groove 128 on the container 110 and engage the second edge 127B of the first rim 127 when the cap 200 is placed on the container 110. The first rim 127 provides an obstruction over the ribs 242 and the hooks 244 that preferably substantially prevents removal of the cap 200 from container 110. As noted above, the ribs 242 and the hooks 244 are symmetrically arranged around the cap volume 202, allowing the cap 200 to be secured onto the container 110 in any orientation without threading or twisting the cap 200 onto the container 110.

Methods of using the container assembly 100 will now be described. Starting with FIG. 1, the cap 200 is shown secured onto the container 110, with the cap 200 in the non-inverted condition. The securing elements 240 on the inner faces 222 of the flanges 220 are preferably retained or trapped within the groove 128, beneath the first rim 127. More specifically, the hooks 244 preferably abut against the second edge 127B of first rim 127, thereby preventing the cap 200 from being removed from the container 110. The cap 200 can be removed by pressing the central portion 230 in the downward direction, for example, the downward direction shown by arrow A in FIG. 3. The central portion 230 preferably deflects downwardly into the cap volume 202 in response to the downward force. After the central portion 230 deflects past a certain point or state, the properties of the cap 200 urge the cap 200 into the inverted condition, at which point the free ends 226 of the flanges 220 spread radially outwardly, as shown in FIG. 7. With the free ends 226 of the flanges 220 spread apart, the ribs 242 and the hooks 244 are no longer held captive between the first rim 127 and the second rim 129, allowing the cap 200 to be removed from the container 110.

Upon removal from the container 110, the cap 200 remains in the inverted condition until sufficient force is applied to the cap 200 to deflect the cap 200 back to the non-inverted condition. Referring to FIG. 7, the cap 200 can be deflected back to the non-inverted condition by either applying an upward force to the underside 201 of the cap 200 in the direction of arrow "B," or by applying a lateral "squeezing" force on the flanges 220 in the directions represented by the opposing arrows "C." Applying a force in either manner, or simultaneously applying an upwardly force and squeezing forces, returns the cap 200 to the non-inverted condition.

The cap 200 can be secured to the container 110 in either of two ways, depending on whether the cap 200 is in the inverted or non-inverted condition upon being placed onto the container 110. If the cap 200 is in the inverted condition (FIG. 7), the cap 200 is placed over the opening 126 of the container 110, with the central portion 230 resting in a centered position over the opening 126. A squeezing force is then applied to the flanges 220 (arrow "C") to deflect the cap 200 to the non-inverted position. When sufficient squeezing force is applied, the free ends 226 of the flanges 220 deflect inwardly, and the securing elements 240 snap into the groove 128 to secure the cap 200 onto the container 110.

If the cap 200 is in the non-inverted condition (FIG. 6), the cap 200 is placed over the opening 126 of container 110 with the central portion 230 centered over the opening 126, and the tapered surfaces 246 on the hooks 244 resting on top of the tapered first edge 127A of the first rim 127. A downward force is then preferably applied to the cap 200. When sufficient force is applied, the tapered surfaces on the hooks 244 bear against and slide against the tapered first edge 127A of the first rim 127, pushing the hooks 244 and flanges 220 slightly radially outwardly until the hooks 244 clear the first rim 127. Once the hooks 244 clear the first rim 127, the hooks 244 preferably snap inwardly into groove 128 and secure the cap 200 to the container 110.

Although the present invention is illustrated and described above with reference to certain specific embodiments, the present invention is not intended to be limited to the details shown. Various modifications may be made in the details within the scope and range of equivalents of the claims and without departing from the invention. For example, although the cap 200 is illustrated with eight flanges 220, the cap 200 may have fewer or more flanges 220. In addition, the flanges 220 of the cap 200 may have a height relative to the body portion 210 that is smaller or larger than that shown. Moreover, the free ends 226 of the flanges 220 need not assume a rectangular configuration with sharp corners as shown, but may incorporate other shapes and geometric features, such as rounded or chamfered corners. The slots 218 and the windows 221 may have various dimensions, depths and shapes to create a desired appearance. The dome shape of the second section 230 of the cap 200 may have other shapes and/or relative dimensions, and still perform the same functions. The container assembly 100 may include container configurations that are different from the container 110. For example, the container 110 may include a rim with one or more gaps instead of a continuous rim like first rim 127.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A child-resistant cap for removably mounting to a container having a neck with a first rim extending laterally outwardly from the neck, the child-resistant cap comprising:

a top wall including an exterior surface, an opposing interior surface, a substantially circular outer peripheral edge, a first section spaced inwardly from the outer peripheral edge and a second section spaced inwardly from the first section, the first section generally surrounding the second section;

a skirt depending downwardly from the outer peripheral edge of the top wall, the skirt including an attached end integrally formed with at least a portion of the outer peripheral edge of the top wall, an opposing free end, a first slot, a second slot and a third slot, the first, second and third slots extending through the skirt, a first aperture, a second aperture and a third aperture extending through the skirt, each of the first, second and third slots extending from the free end of the skirt toward the outer peripheral edge of the top wall, each of the first, second and third apertures spaced-apart from the free end of the skirt and including a top end and a lower end; and a plurality of hooks, including a first hook, a second hook and a third hook, extending radially inwardly from an inner surface of the skirt, the first hook positioned proximate the lower end of the first aperture, the second hook positioned proximate the lower end of the second aperture and the third hook positioned proximate the lower end of the third aperture, the top wall has a first configuration in which a geometric center of the top wall extends beyond a plane defined by the outer peripheral edge thereof and the attached edge of the skirt, and a second configuration in which the geometric center of the top wall does not extend beyond the plane defined by the outer peripheral edge thereof and the attached edge of the skirt, the free end of the skirt extends radially outwardly from the attached end thereof to allow the cap to be removed from the container in the second configuration.

2. The child-resistant cap of claim 1, wherein in the first configuration the first section of the top wall is generally planar and the second section of the top wall is generally arcuate, wherein in the first configuration the skirt extends generally perpendicularly relative to the first section of the top wall to generally engage at least a portion of a container.

3. The child-resistant cap of claim 1, wherein the first aperture is positioned between the first and second slots, the second aperture is positioned between the second and third slots and the third aperture is positioned between the first and third slots.

4. The child-resistant cap of claim 1, wherein the first, second and third slots extend into the outer peripheral edge and the first section.

5. The child-resistant cap of claim 1, wherein the first, second and third apertures extend into the outer peripheral edge and the first section.

6. The child-resistant cap of claim 1, further comprising fourth, fifth, sixth, seventh and eighth slots.

7. The child-resistant cap of claim 6, further comprising fourth, fifth, sixth, seventh and eighth apertures.

8. The child-resistant cap of claim 1, further comprising:

a first liner attached to the interior surface of the top wall.

9. A child-resistant cap for removably mounting to a container having a neck with a first rim extending laterally outwardly from the neck, the child-resistant cap comprising:

a top wall including an exterior surface, an opposing interior surface, a substantially circular outer peripheral edge, a first section spaced inwardly from the outer peripheral edge and a second section spaced inwardly from the first section, the first section generally surrounding the second section;

a skirt depending downwardly from the outer peripheral edge of the top wall, the skirt including an attached end integrally formed with at least a portion of the outer peripheral edge of the top wall, an opposing free end, a plurality of slots extending through the skirt from the free end and through the outer peripheral edge, a plurality of apertures being spaced from the free end and extending through the outer peripheral edge of the skirt; and a plurality of hooks extending radially inwardly from an inner surface of the skirt, the top wall has a first configuration in which a geometric center of the top wall extends beyond a plane defined by the outer peripheral edge thereof and the attached edge of the skirt, and a second configuration in which the geometric center of the top wall does not extend beyond the plane defined by the outer peripheral edge thereof and the attached edge of the skirt, the free end splaying outwardly in the second configuration, the cap configured such that a downward force on the exterior surface is applied to the cap to move between the first configuration and the second configuration and a lateral squeezing force is applied to the skirt to move between the second configuration and the first configuration, the cap substantially remaining in one of the first and second configuration until one of the downward and lateral squeezing forces is applied.

10. The child-resistant cap of claim 9, wherein the downward force is applied to a center of the second section of the top wall.

11. The child-resistant cap of claim 9, wherein the plurality of slots includes a first slot, a second slot and a third slot and the plurality of apertures includes a first aperture, a second aperture and a third aperture.

12. The child-resistant cap of claim 11, wherein plurality of hooks includes a first hook, a second hook and a third hook.

13. The child-resistant cap of claim 12, wherein the first hook is positioned proximate a lower end of the first aperture, the second hook is positioned proximate a lower end of the second aperture and the third hook is positioned proximate a lower end of the third aperture.

14. The child-resistant cap of claim 11, wherein the first aperture is positioned between the first slot and the second slot, the second aperture is positioned between the second slot and the third slot and the third aperture is positioned between the first slot and the third slot.

15. The child-resistant cap of claim 9, further comprising:

a first liner attached to the interior surface of the top wall.

16. A child-resistant container assembly for storing various types of material, the child-resistant container assembly comprising:

a container having a body and a neck, the neck including a first annular rim and a second annular rim spaced-apart from the first annular rim, each of the first and second annular rims extending around the neck; and a cap including a top wall having an exterior surface, an opposing interior surface, a substantially circular outer peripheral edge, a first section spaced inwardly from the outer peripheral edge and a second section spaced inwardly from the first section, a skirt depending downwardly from the outer peripheral edge of the top wall, the skirt including an attached end integrally formed with at least a portion of the outer peripheral edge of the top wall, the skirt including an opposing free end, a plurality of slots extending through the skirt from the free end and through the outer peripheral edge and a plurality of apertures being spaced from the free end and extending through the outer peripheral edge, a plurality of flanges defined by the plurality of slots, a plurality of hooks extending radially inwardly from an inner surface of the skirt, the cap has a first configuration in which a geometric center of the top wall extends beyond a plane defined by the outer peripheral edge thereof such that the plurality of hooks are configured to engage under the first annular rim, the cap also has a second configuration in which the geometric center of the top wall does not extend beyond the plane defined by the outer peripheral edge thereof and the attached edge of the skirt such that the plurality of flanges are splayed and the plurality of hooks are spaced from the first annular rim.

17. The child-resistant container assembly of claim 16, wherein the plurality of slots include a first slot, a second slot and a third slot and the plurality of flanges include a first flange, a second flange and a third flange, the first flange defined between the first and second slots and the second flange defined between the second and third slots.

18. The child-resistant container assembly of claim 16, wherein the plurality of aperture include a first aperture, a second aperture and a third aperture and the plurality of hooks include a first hook, a second hook and a third hook, the first hook positioned at a lower end of the first aperture, the second hook positioned at a lower end of the second aperture and the third hook positioned at a lower end of the third aperture.

19. The child-resistant container assembly of claim 18, wherein the first and second annular rims define an annular groove, the plurality of hooks positioned in the annular groove when the cap is mounted to the container and the cap is in the first configuration, the hooks engaging the annular groove in a snap-fit connection when the cap is mounted to the container.

* * * * *